US005949302A

United States Patent [19]

Särkkä

[11] Patent Number: 5,949,302

[45] **Date of Patent: *Sep. 7, 1999**

[54] METHOD FOR TUNING A SUMMING NETWORK OF A BASE STATION, AND A BANDPASS FILTER

[75] Inventor: Veli-Matti Särkkä, Oulunsalo, Finland

[73] Assignee: Nokia Telecommunications Oy, Espoo, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/809,942

[22] PCT Filed: Sep. 14, 1995

[86] PCT No.: PCT/FI95/00502

§ 371 Date: Mar. 13, 1997

§ 102(e) Date: Mar. 13, 1997

[87] PCT Pub. No.: WO96/08848

PCT Pub. Date: Mar. 21, 1996

[30] Foreign Application Priority Data

Sep. 15, 1994 [FI] Finland ..... 944283

[51] Int. Cl.[6] ..... H01P 5/12; H01P 7/10

[52] U.S. Cl. ..... 333/126; 333/134; 333/202; 333/235

[58] Field of Search ..... 333/126, 129, 333/132, 134, 161, 202, 219.1, 230, 235

[56] References Cited

U.S. PATENT DOCUMENTS

| | | | |
|---|---|---|---|
| 3,673,518 | 6/1972 | Carr | 333/1.1 |
| 4,633,203 | 12/1986 | Nowak | 333/230 X |
| 4,667,172 | 5/1987 | Longshore et al. | 333/134 |
| 5,212,463 | 5/1993 | Babbitt et al. | 333/161 |
| 5,315,274 | 5/1994 | Sarkka | 333/219.1 |
| 5,677,654 | 10/1997 | Sarrka | 333/219.1 X |

FOREIGN PATENT DOCUMENTS

| | | | |
|---|---|---|---|
| 61-218202 | 9/1986 | Japan | 333/235 |
| 6-6120 | 1/1994 | Japan | 333/235 |

OTHER PUBLICATIONS

Kuchler, Ceramic Resonators for Highly Stable Oscillators, Siemens Components XXIV (1989) No. 5.

Fiedziuszko, Microwave Dielectric Resonators, Microwave Journal, Sep. 1986, pp. 189–198.

Pospieszalski, Cylindrical Dielectric Resonators and Their Applications in TEM . . . , IEEE, No. 3, Mar. 1979, pp. 233–238.

*Primary Examiner*—Seungsook Ham
*Attorney, Agent, or Firm*—Pillsbury Madison & Sutro LLP

[57] ABSTRACT

For tuning a summing network of a base station which has connectors, conductors and a filter, including input connectors for receiving signals supplied by radio transmitters of the base station, and output connectors for feeding the filtered signals further to an antenna, a bandpass filter is provided. The summing network can be optimized on the correct frequency, by adjustment of the electric length of an output connector of the filter.

8 Claims, 2 Drawing Sheets

METHOD FOR TUNING A SUMMING NETWORK OF A BASE STATION, AND A BANDPASS FILTER

This application is the national phase of international application PCT/FI95/00502, filed Sep. 14, 1995 which designated the U.S.

BACKGROUND OF THE INVENTION

The present invention relates to a method for tuning a summing network of a base station, which summing network consists of connectors, conductors and a filtering means which include input connectors for receiving signals supplied by radio transmitters of the base station, and output connectors for feeding the filtered signals further to an antenna means. The invention further relates to a bandpass filter comprising an input connector, an output connector and a resonating means.

The invention particularly relates to a summing network for combiner filters in a base station of a cellular mobile communication network. A combiner filter is a narrow-band filter which resonates exactly on the carrier frequency of a transmitter coupled to it. The signals from the outputs of the combiners are summed by the summing network and fed further to the base station antenna. The summing network usually consists of a coaxial cable leading to the base station antenna, to which coaxial cable the combiner filters are usually coupled by T-branches. In order that as much as possible of the transmitting power of the transmitters can be forwarded to the antenna, the summing network should be tuned with regard to frequency channels used by the transmitters of the base station. Thus, the optimal electric length of the summing network is dependent on the wavelength of the carrier wave of the signal to be transmitted. Strictly speaking, a summing network is thereby tuned on one frequency only, but the mismatch does not at first increase very fast when the frequency changes away from the optimum. Thus, base stations of cellular communication systems can usually use the summing network on a frequency band whose width is approximately 1–2% of the center frequency of the frequency band used by the base station. This sets very high requirements for the mechanical length of the summing network and its cabling, because the transmission lines must be of precisely the correct length in order for the summing network to be optimized on the correct frequency. In addition, the usable frequency band of a summing network is too narrow for the frequency channels of the base station transmitters to be changed very much without having to deal with the tuning of the summing network. As especially such combiner filters that are automatically tuned (by remote control) have become more common, need has arisen for simple and fast change in the tuning of the summing network. The prior art solution, according to which it was necessary for an engineer to visit the base station site and to replace the summing network cabling with a new cabling measured for the new frequency band, is understandably too expensive and time consuming a procedure.

SUMMARY OF THE INVENTION

It is an object of the present invention to solve the aforementioned problem and to provide a method for an easy and simple tuning of a summing network of a base station. This object is achieved by a summing network of the invention, which is characterized in that the electric length of an output connector of a filtering means in the summing network is adjusted.

The invention is based on the idea that it is, in conjunction with tuning of the summing network, altogether unnecessary to deal with the fixed summing network of the base station when the base station uses combiner filters or a combiner filter with an output connector whose electric length can be adjusted. Such an adjustment compensates for a wavelength error caused by different wavelengths in the fixed summing network, whereby by adjusting the electric length of the output connector it is possible to maintain the combined electric length of the cable connected to the summing point of the summing network and the connector of the filter always correct, i.e. $L=n*\lambda/4$ where n=1, 3, 5 . . . , and $\lambda$=the wavelength in the cable. Thus, the most significant advantage of the method of the invention is that the mechanical length of the summing network cabling becomes less significant, because errors in the cable measures can be corrected by adjusting the output connector of the filter. This makes the tuning of the summing network easier and faster, and, furthermore, the costs of cabling decrease due to less strict tolerance requirements.

The invention further relates to a bandpass filter which is characterized in that the bandpass filter comprises adjusting means for changing the electric length of the connector belonging to it. In the filter of the invention, advantageously at least the electric length of the output connector is adjustable. In addition, the input connector of the filter may be adjustable as well, whereby it is in some cases possible to improve other parameters (passband attenuation, bandwidth and group propagation delay) of the filter to remain constant.

In a preferred embodiment of a filter according to the present invention, the filter connector interacts with the resonating means through a microstrip conductor. Consequently, the electric length of the connector depends on the electric length of the microstrip conductor, which, in turn, depends on its effective dielectric constant. Thus, the electric length of the filter connector can be changed very simply, i.e. by influencing the effective dielectric constant of the microstrip conductor.

In a second preferred embodiment of the filter according to the present invention, the effective dielectric constant of the microstrip conductor is adjusted mechanically, i.e. the microstrip conductor is arranged between an object made of an insulating material and an object made of dielectric, advantageously ceramic, material. Consequently, the main portion of the electromagnetic field of the microstrip conductor appears between the microstrip conductor and the ground plane ($Z_0 \leqq 50$ Ohm), and the rest above it. If the weaker stray field above the microstrip conductor is changed, for example by changing the dielectric constant of the medium effecting the stray field by means of introducing in it ceramic material with a high dielectric constant, the effective dielectric constant of the microstrip conductor also changes, and, consequently, so does its electric length. So, by moving said ceramic material by means of, for example, an adjusting screw, so that the area of the microstrip conductor covered by it alters, the electric length of the connector of the filter can be changed. This type of mechanical adjusting according to the invention is very advantageous in conjunction with a dielectric resonator, because the same adjusting screw can be used for changing the resonance frequency of the resonator and the electric length of the connector.

In a third preferred embodiment of the filter according to the invention, the effective dielectric constant of the microstrip conductor is adjusted by an electric adjustment. This means that the microstrip conductor is arranged against the surface of an object at least partly made of material whose dielectric constant depends on the field strength of a surrounding electric field. As the dielectric constant of said object alters, the effective dielectric constant of the microstrip conductor consequently changes. So, by adjusting the field strength of the electric field surrounding the microstrip conductor, the electric length of the connector of the filter can be changed.

BRIEF DESCRIPTION OF THE DRAWINGS

In the following, the invention will be described in closer detail by means of some preferred embodiments of the bandpass filter according to the invention, with reference to the accompanying drawings, in which.

DETAILED DESCRIPTION

Figure 1:
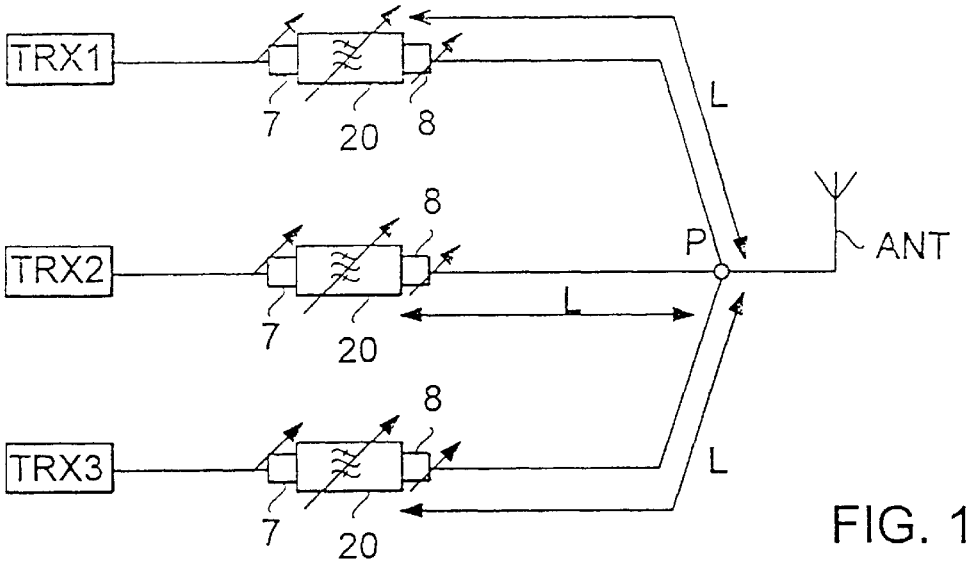
FIG. 1 shows a block diagram of a summing network of a base-station.

FIG. 1 is a block diagram of a summing network of a cellular communication system, such as the Global System for Mobiles, GSM. Transmission units TRX1–TRX3 of FIG. 1 use a common antenna ANT for transmitting and receiving radio signals. For each transmitter, a separate combiner filter 20 is arranged in the base station. The combiner filter 20 consists of a tunable bandpass filter, and the transmitters feed the RF signals to be transmitted to its input connector 7. The output connectors 8 of the bandpass filters 20 are connected by coaxial cables to a summing point P from which the signals supplied by the transmitters are further fed to the antenna ANT.

In the summing network of FIG. 1, tunable combiner filters 20 are used, whereby the operator is able to change the resonance frequency of the filters to correspond to the center frequency of the frequency band used by the transmitter unit coupled to it. Alternatively, a control unit which automatically adjusts the filters may be located in connection with the filters.

In addition, the electric length of the input and output connectors 7 and 8 of the filters in FIG. 1 is adjustable. Consequently, the cabling of the summing network in FIG. 1 need not be changed in order to tune the summing network. In FIG. 1, the tuning of the summing network is carried out by adjusting the electric length of the output connector 8 of each combiner filter 20 so that the combined electric length of the output connector and the coaxial cable interconnecting the output connector of the filter to the summing point P is $L=n*\lambda/4$, where n=1, 3, 5 . . . , and $\lambda$=wavelength in the coaxial cable. Adjusting the electric length of the input and output connectors 7 and 8 may in the case of FIG. 1 be automatically carried out in connection with changing the tuning frequency of the filter 20, for example by remote control from the control room of the system.

Figure 2:
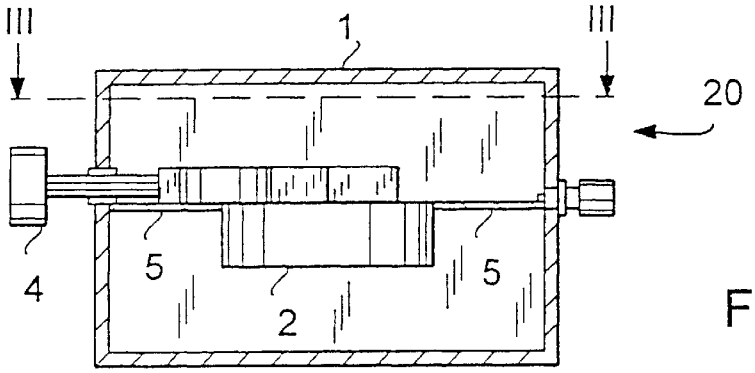
FIG. 2 illustrates the first preferred embodiment of the filter according to the invention.
Figure 3:
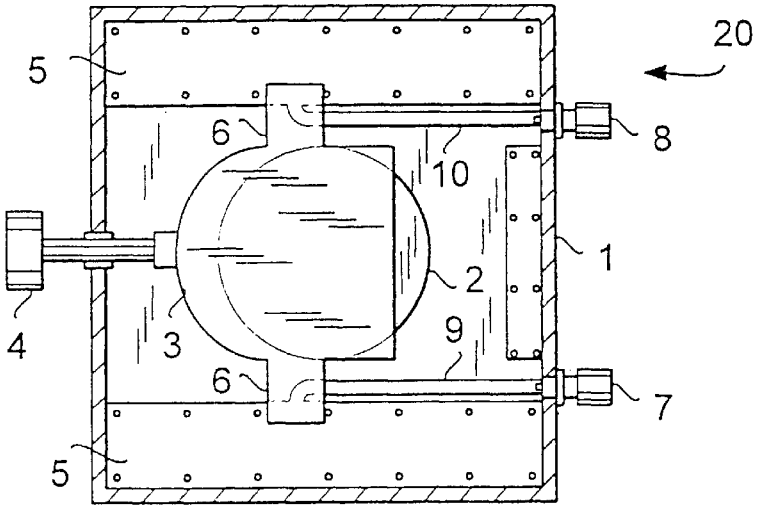
FIG. 3 shows the filter illustrated in FIG. 2 cut along line III—III of FIG. 1.

FIG. 2 illustrates the first preferred embodiment of the filter according to the invention, in which the electric length of the connectors of the filter 20 is adjusted mechanically. FIG. 1 shows a side view of the bandpass filter 20 whose frame structure consists of a closed metal casing 1 which is connected to ground potential. FIGS. 2 and 3 show the casing 1 cut open. An adjustable dielectric resonator consisting of two ceramic disks, 2 and 3, has been arranged in casing 1. The disks have been placed one above the other so that their surfaces face one another. The term disk in this context refers to an essentially cylindrical object which may, however, have tabs or other minor deviations from the cylindrical form.

In FIG. 2, the lower, an essentially cylindrical disk 2 is bonded to the casing 1 by means of circuit board 5 attached to the casing 1 wall. The circuit board is made of an insulating material, but its top and bottom surface may contain areas that are made of conductive material and connected to ground potential (as in FIG. 3). The upper disk 3 can be moved above the lower disk 2 by means of the adjusting screw 4 which goes through the casing 1 wall. As the screw 4 is turned, the upper disk in FIG. 1 moves horizontally. As a response to that movement, the resonance frequency of the dielectric resonator changes. The structure, operation and the ceramic materials the adjustable dielectric resonators are made of are described, for example, in the following publications.

(1) "Ceramic Resonators for Highly Stable Oscillators", Gundolf Kuchler, Siemens Components XXXIV (1989) No. 5, p. 180–183

(2) "Microwave Dielectric Resonators", S. Jerry Fiedziuszko, Microwave Journal, September 1986, p. 189–.

(3) "Cylindrical Dielectric resonators and Their Applications in TEM Line Microwave Circuits", Marian W. Pospieszalski, IEEE Transactions on Microwave Theory and Techniques, Vol. MTT-27, No. 3, March 1979, p. 233–238.

(4) Finnish Patent 88 227, "Dielektrinen resonaattori".

FIG. 3 shows the filter illustrated in FIG. 2 cut along the line III—III of FIG. 2, i.e. FIG. 3 shows the filter from above. FIG. 3 shows that there is a hole in the circuit board 5 to which the resonator disks 2 and 3 are arranged. In addition, FIG. 3 shows that the tabs of the upper disk 3 slide along the surface of the circuit board 5.

The input and output connectors 7 and 8 of the filter are connected to the microstrip conductors 9 and 10 on the surface of the circuit board 5. The microstrip conductors 9 and 10 can be made of some highly conductive material, such as copper, aluminum or gold alloys. In FIG. 3, the tabs 6 of the upper disk 3 cover a portion of the surface area of the microstrip conductor. The effective dielectric constant and the electric length of the microstrip conductors depend on the size of that surface area. As the adjusting screw 4 is turned, the upper disk 3 moves with regard to the fixed lower disk 2, and consequently the tabs 6 move with regard to the microstrip conductors 9 and 10, causing that surface area to alter. Thus, the tuning frequency of the bandpass filter 20, and the electric length of its input connector 7 and output connector 8 simultaneously are changed by one single adjusting means, i.e. the screw 4.

Figure 4:
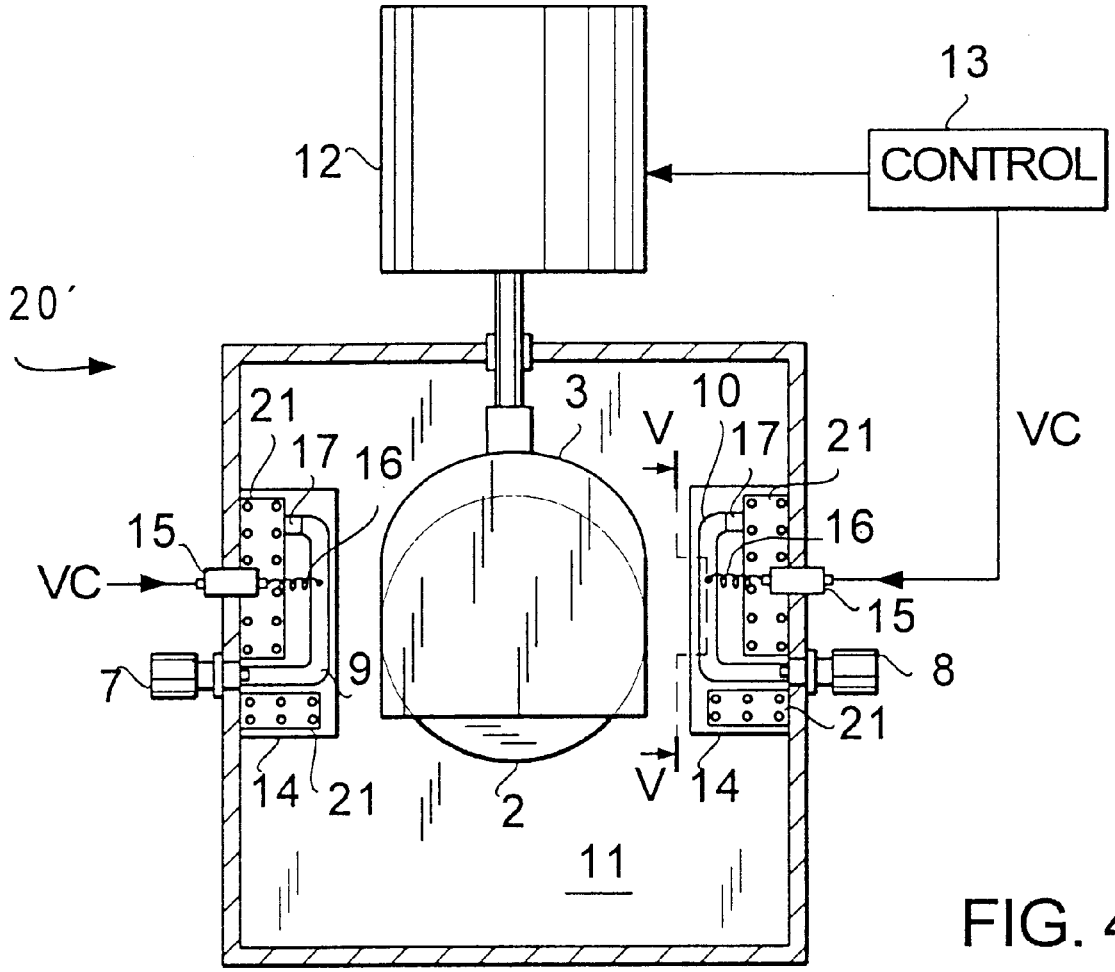
FIG. 4 illustrates the second preferred embodiment of the filter according to the invention.

FIG. 4 illustrates a second preferred embodiment of the filter according to the present invention. The bandpass filter 20' is housed in a metal casing 1. The lower disk 2 of the dielectric resonator within the filter is essentially cylindrical and attached to a fixed position with regard to the bottom 11 of the casing 1 by means of a support made of dielectric material (not shown in the figure). The upper disk 3 of the resonator is arranged to be moved with regard to the lower disk 2, as in FIG. 2. The upper disk can be moved by means of the adjusting screw 4, which is operated by a stepping motor 12 under control of a control unit 13.

In FIG. 4, in connection with the input and output connectors there are two circuit boards 14 having a bedded structure arranged on the casing wall, and the microstrip conductors 9 and 10 are arranged on the surfaces of the circuit boards. A portion of the circuit board 14 surface is covered with conductive boards 21 that are connected to the grounding by the casing wall. Below the circuit boards there are similar boards 18 (cf. FIG. 5). The boards above and below are coupled in points indicated by dots shown in FIG. 4 on boards 21.

Below the microstrip conductors 9 and 10, there is in the circuit boards 14 a layer made of ferroelectric material, the dielectricity of which layer depends on the magnitude of the surrounding electric field. Such material, Ba—Sr—$TiO_3$-based, for example, is commercially available. In order to create an electromagnetic field, there are feedthrough capacitors 15 arranged in the casing 1 wall for feeding the DC signal VC produced by the control unit 13 to the feed coils 16 which are connected to the microstrip conductors 9 and 10, and additionally decoupling capacitors 17, whose one pole is grounded by the boards 21, are arranged in the ends of the microstrip conductors.

Figure 5:
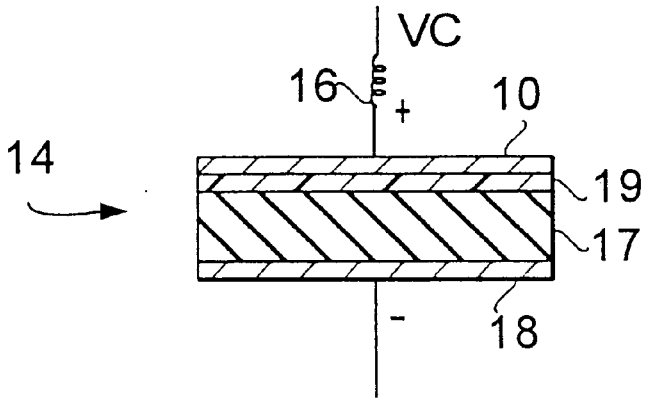
FIG. 5 shows the circuit board illustrated in FIG. 4 cut along line V—V.

FIG. 5 illustrates a section of the circuit board 14 of FIG. 4, cut along the line V—V. Thus, the circuit board has been cut at the microstrip conductor 10. FIG. 5 shows that the circuit board 14 is comprised of a dielectric layer 17 with a conductive layer 18 made of copper and connected to the grounding arranged on its bottom surface. On the top surface of the dielectric layer 17, a ferroelectric layer 19 is arranged, and on the layer 19 another copper layer is arranged, i.e. the microstrip conductor 10, which is coupled to the feed coil 16 in order to produce a positive charge.

The ferroelectric layer 19 is thus located in a electromagnetic field produced between the copper surface layers (electrodes) 18 and 10, whereby the control unit 13 may change its dielectric constant by adjusting the DC signal VC. Consequently, the effective dielectric constant and, as a result, the electric length of the microstrip conductor 10 change.

It should be understood that the description and the attached drawings are only meant to illustrate the present invention. Different kinds of variations and modifications will be obvious for a person skilled in the art without departing from the scope and spirit of the attached claims. Thus, it is obvious for a person skilled in the art that, instead of a dielectric resonator, another kind of a resonator may be used in a bandpass filter according to the invention, for example, a waveguide resonator or a coaxial resonator, and that the adjustment of the filter output connector may also be carried out by adjusting means arranged outside of the filter casing.

What is claimed is:

1. A mobile communication network base station having a tunable summing network, comprising:

a first transmitter branch and a second transmitter branch, each having a radio transmitter and a filter with an input connector for receiving signals supplied by the respective radio transmitter and an output connector for feeding further the signals filtered by the respective filter and frequency adjusting means for adjusting filtering frequency of each said filter;

an antenna connected to said output connectors, for receiving filtered signals from the first and second transmitter branches via the respective said output connectors;

each of said output connectors having respective adjusters which are adjustable separately from one another, for changing the electrical lengths of the respective ones of said output connectors, said respective adjusters being functionally coupled to said frequency adjusting means, whereby the electrical length of said respective output connector changes as a response to a change of the resonance frequency of the respective said filter.

2. A bandpass filter comprising:

an input connector;

an output connector; a resonating means arranged to receive output from said input connector and provide output to said output connector;

resonance adjusting means for adjusting a resonance frequency of said resonating means; and adjusting means for changing the electric length of said output connector, said adjusting means being functionally coupled to said resonance adjusting means, whereby the electrical length of said output connector changes as a response to a change of the resonance frequency of said resonating means.

3. The bandpass filter as claimed in claim 2, wherein:

a microstrip conductor having an effective dielectric constant is included in said output connector, whereby said output connector is adapted to interact with said resonating means through said microstrip conductor, and said adjusting means are arranged to change the electric length of said output connector by changing the effective dielectric constant of said microstrip conductor.

4. The bandpass filter as claimed in claim 3, further comprising:

a circuit board made of an insulating material, and having a first surface on which the microstrip conductor is arranged; and said adjusting means comprising a displaceable dielectric disk which is arranged on an opposite side of the microstrip conductor with regard to said circuit board, so that said displaceable disk covers at least a portion of the area of said microstrip conductor; and said adjusting means further comprising means for moving the displaceable disk with regard to the microstrip conductor, in order to alter said area so that the effective dielectric constant and the electrical length of the microstrip conductor change.

5. A bandpass filter comprising:

an input connector;

an output connector; a resonating means arranged to receive output from said input connector and provide output to said output connector;

adjusting means for changing the electric length of said output connector;

a microstrip conductor having an effective dielectric constant is included in said output connector, whereby said output connector is adapted to interact with said resonating means through said microstrip conductor, and said adjusting means are arranged to change the electric length of said output connector by changing the effective dielectric constant of said microstrip conductor;

a circuit board made of an insulating material, and having a first surface on which the microstrip conductor is arranged;

said adjusting means comprising a displaceable dielectric disk which is arranged on an opposite side of the microstrip conductor with regard to said circuit board, so that said displaceable disk covers at least a portion of the area of said microstrip conductor; and said adjusting means further comprising means for moving the displaceable disk with regard to the microstrip conductor, in order to alter said area so that the effective dielectric constant and the electrical length of the microstrip conductor change;

said resonating means being a dielectric resonator comprising said displaceable dielectric disk and a second dielectric disk, said disks having respective surfaces arranged to face each other; and said displaceable disk being adapted to be moved radially with regard to said, second dielectric disk, in order to adjust the resonance frequency of said dielectric resonator.

6. The bandpass filter as claimed in claim 4, wherein: said dielectric disk is made of a ceramic material.

7. The bandpass filter as claimed in claim 3, further comprising:

a layered circuit board having at least one layer made of a material whose dielectric constant depends on the field strength of a surrounding electromagnetic field; and said microstrip conductor being arranged on a surface of said layer, whereby the adjusting means comprise means for producing an electromagnetic field with an adjustable field strength.

8. A bandpass filter as claimed in claim 3, further comprising:

a casing made of a conductive material, said casing housing said resonating means.

* * * * *